US008230603B2

(12) United States Patent
Currie

(10) Patent No.: US 8,230,603 B2
(45) Date of Patent: Jul. 31, 2012

(54) AMBIDEXTROUS SPILL-RESISTANT SPOON

(75) Inventor: Phillip Currie, BuenaPark, CA (US)

(73) Assignee: Philip V. Currie, Buena Park, CA (US)

( * ) Notice: Subject to any disclaimer, the term of this patent is extended or adjusted under 35 U.S.C. 154(b) by 373 days.

(21) Appl. No.: 12/589,183

(22) Filed: Oct. 20, 2009

(65) Prior Publication Data

US 2011/0088266 A1 Apr. 21, 2011

(51) Int. Cl.
*A47G 21/08* (2006.01)

(52) U.S. Cl. ..... 30/324; 30/342; 414/9

(58) Field of Classification Search ..... 30/324–328, 30/342, 340, 526; 16/110.1; 414/9
See application file for complete search history.

(56) References Cited

U.S. PATENT DOCUMENTS 2,571,264 A * 10/1951 Legarra ..... 416/72
2,636,266 A * 4/1953 Sweet ..... 30/324
2,741,027 A * 4/1956 Efraim ..... 30/324
2,809,426 A * 10/1957 Pickering ..... 30/324
4,028,803 A * 6/1977 Currie ..... 30/321
4,389,777 A * 6/1983 Landsberger ..... 30/324
5,603,163 A * 2/1997 Ikner, Jr. ..... 30/324
6,393,704 B1 * 5/2002 Tompkins et al. ..... 30/324
7,178,247 B2 * 2/2007 Currie ..... 30/324
7,416,377 B2 * 8/2008 Currie ..... 414/9
2006/0288589 A1 * 12/2006 Verona ..... 30/324

* cited by examiner

*Primary Examiner* — Sean Michalski

(57) ABSTRACT

An ambidextrous spill-resistant spoon includes a handle portion carrying a spoon bowl portion. The spoon bowl is rotational relative to the handle portion and depends below the handle portion to self-level rather as a pendulum seeks the vertical. But, the spoon bowl is clutched non-rotationally to the handle portion during a scooping motion to load the spoon with food. As soon as the scooping motion is completed by clearing of the spoon bowl from the food, the bowl portion is un-clutched from the handle portion and becomes freely pivotal so as to remain level as a user moves the loaded spoon toward the user's mouth.

15 Claims, 3 Drawing Sheets

FIG. 1
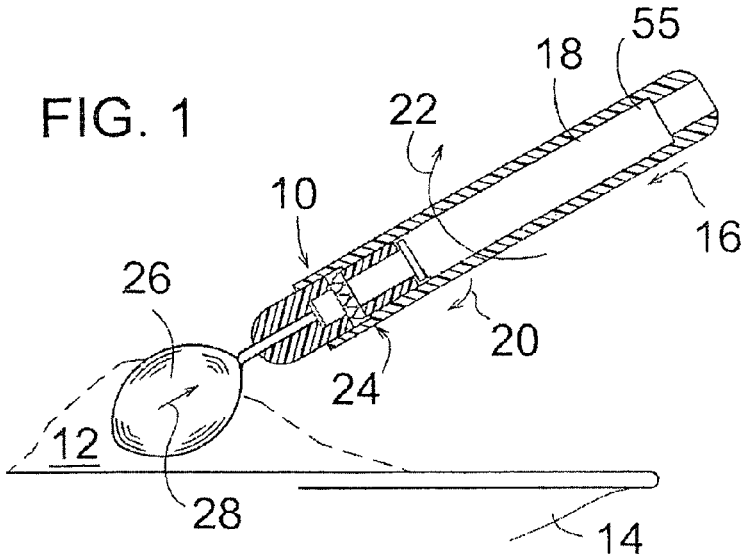
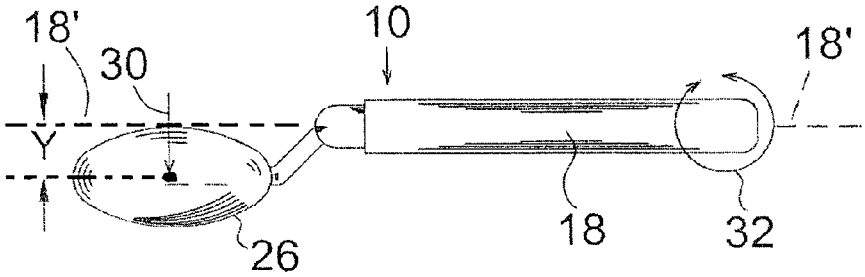
FIG. 2
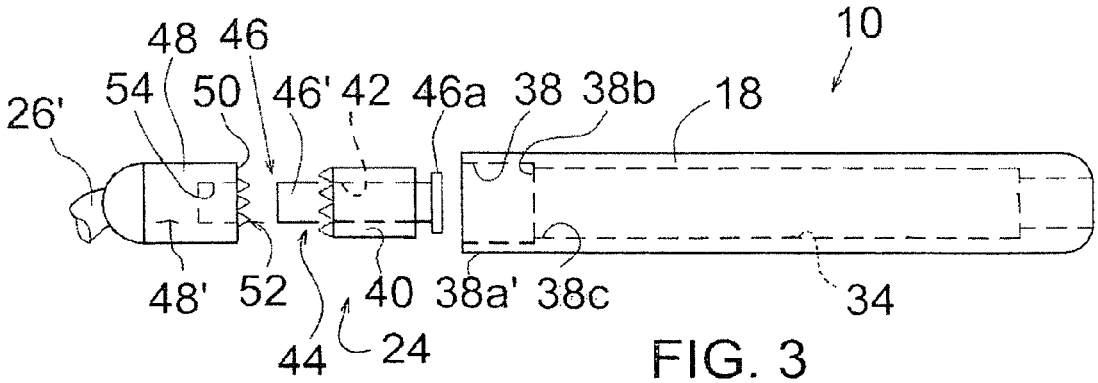
FIG. 3

AMBIDEXTROUS SPILL-RESISTANT SPOON

CROSS REFERENCE TO RELATED APPLICATIONS

The invention disclosed in this application is related to the inventions patented in U.S. Pat. No. 7,416,377, granted 26 Aug. 2008, which was a Divisional application of U.S. Pat. No. 7,178,247, granted 20 Feb. 2007.

FIELD OF THE INVENTION

The present invention relates to improvements in a spoon having a handle portion and a spoon bowl portion relatively rotationally connected by a rotational mechanism including a selectively operable clutching mechanism. The rotational mechanism allows the spoon bowl to swing freely like a pendulum (i.e., responsive to gravitational torque) below and relative to an axis passing longitudinally along the handle portion. A selected radial sag or clearance is also provided, as is a dual-acting axial wedging or forcing effect resulting from any one (or a combination) of gravitational torque, and the result of the radial sag in response to gravity.

The selectively operable clutching mechanism engages the handle portion and the bowl portion in response to axial force and torque resulting from a user scooping up food. When the user lifts the food on the spoon, the clutching mechanism is responsive to a combination of forces, including a torque provided by gravity acting through a lever arm resulting from offset of the spoon bowl relative to the axis (which is effective in both rotational directions), and the gravitational vector tending to make the spoon bowl sag slightly relative to the handle so as to implement the dual-acting axial wedging effect (which is also effective in both rotational directions), and to un-clutch and allow the bowl portion to swing freely relative to the handle portion. As a result, those who have undeveloped or impaired coordination enjoy greater success in using the spoon to feed themselves.

BACKGROUND OF THE INVENTION

A variety of improved spoons have been made in order to facilitate use by individuals with undeveloped or impaired coordination (i.e., infants or stroke victims, for example). These spoons are intended to allow infants, the elderly, and the disabled to participate more fully in feeding themselves.

Improvements in conventional spoons of this character sometimes relate to weighting or texturing or configuring the handle (See, for example, U.S. Pat. No. 4,389,777), such that the handle is more easily grasp or manipulated. This expedient does not address the undeveloped or impaired coordination that may prevent the user from being able to accomplish leveling of the spoon bowl so that food does not fall off the side of the spoon. The user may not even be aware of the need for (or their inability to) accomplish leveling of the spoon bowl.

Other improved conventional spoons simply allow the bowl portion to swing freely like a pendulum relative to the handle (See, U.S. Pat. No. 6,393,704), and it is known to add additional weighting to the bowl portion or to a shaft carrying the bowl portion to increase the pendulum action (i.e., self leveling action) of the spoon bowl. This conventional expedient makes such a spoon a very difficult utensil when it is desired to scoop up food onto the spoon. Even a person with perfectly normal coordination in attempting to use such a spoon will find that the utensil is frustrating and requires a special concentration and coordination in order to scoop up food into the freely swinging spoon bowl. Such a utensil is very frustrating for those with undeveloped or impaired coordination.

Other conventional improved spoons add various versions and arrangements of clutches to momentarily engage (rotationally lock for movement in unison) the spoon bowl to the handle to improve the action of the spoon in scooping up food (See, for example, U.S. Pat. Nos. 2,636,266; 2,741,027; 4,028,803; 4,993,156; and 5,630,276). Some of these clutches or locking mechanisms are to be manually operated, which may be beyond the understanding of an infant, or beyond the physical ability of the elderly or physically impaired. Other clutch mechanisms are intended to engage and disengage in response to the forces, angulations, and rotations of a spoon in use. U.S. Pat. No. 2,636,266 is an example of this intention. However, consideration of FIG. 2 of the '266 patent will show that the spoon must be pushed into the food in an unnatural way in order to get that particular clutch mechanism to engage. If the spoon is used in a natural scooping motion, the clutch will disengage at the time when the user would want it to be engaged. Once the bowl of the spoon is loaded with food, the clutch of the '266 patent would appear to un-clutch as desired, as is seen in FIG. 5 of the '266 patent. Consideration of the operation of the '266 patent makes clear that any clutching mechanism must not only disengage when desired once the spoon bowl is loaded with food, but must also engage in response to the most natural scooping motions that a user will make in attempting to use the spoon.

Another spoon including a clutch mechanism attempts to use a spring-loaded mechanism in order to effect clutching and un-clutching of the spoon bowl and handle (See, for example, U.S. Pat. No. 2,741,027). However, these mechanisms are subject to sticking and fouling either on their own or as a result of food entering the mechanism. Some spoons of this character require angulation or tipping of the handle portion to effect clutching and un-clutching (See my own U.S. Pat. No. 4,028,803, for example). Still other spoons of this character add manual clutch operating features (such as a clutch operated by a thumb pad) or have exterior protrusions, levers, or bob weights, all of which are not desirable for use by an infant or the impaired.

SUMMARY OF THE INVENTION

In view of the above, an object for this invention is to reduce or eliminate the effect of one or more of the deficiencies of the conventional art.

In accordance with the principles of the present invention, an ambidextrous spill-resistant spoon includes two relatively rotational pieces, one of which is an elongate handle portion preferably having a through bore and defining a longitudinal axis. The spill-resistant spoon includes a spoon bowl portion disposed at one end of the handle portion and having a rotational shaft part, and a rotational clutching apparatus cooperatively defined by features of the handle portion and the shaft part, and providing for the spoon bowl to be relatively rotationally supported below the longitudinal axis and somewhat spaced axially from the handle part, the rotational and clutching apparatus further is responsive to a user action including an axial force pushing the handle portion and spoon bowl toward one another to clutch the spoon bowl non-rotationally to the handle portion to resist torque in both directions in the presence of the axial force, and in the absence of the axial force the rotational and clutching apparatus being responsive to a combination of forces including torque produced gravitationally (which is effective in both rotational directions), and/or dual-effect or dual-acting axial wedging or separating force produced gravitationally (which is also effective in both rotational directions—as will be explained), to un-clutch allowing the spoon bowl to freely rotate about the longitudinal axis. Thus, the present inventive spill-resistant spoon un-clutches singularly in response to gravitational forces. Further, because the spoon bowl is clutched to the handle portion in opposition to torque in both directions during a natural food-scooping motion, the present spill-resistant spoon is ambidextrous, and can be used alternatively left-handed or right-handed. Still further, the present inventive spoon is uniquely easy and safe to clean including only two permanently united parts, and being substantially open internally to cleaning water with no hidden crevices which could trap food particles.

These and other features and advantages of the present invention will be readily apparent from a thoughtful consideration of the following detailed description of one exemplary embodiment of the invention. This detailed description will be better understood in conjunction with the accompanying drawings, wherein like reference characters represent like elements, as follows:

BRIEF DESCRIPTION OF THE DRAWING FIGURES

FIG. 1 is a fragmentary perspective view partially in cross section of an exemplary spoon according to this invention being used to scoop up food as from a bowl;

FIG. 2 is a side elevation view of the ambidextrous spill-resistant spoon seen in FIG. 1;

FIG. 3 is an exploded side elevation view, partially in cross section, and at an enlarged size compared to FIGS. 1 and 2, of an ambidextrous spill-resistant spoon according to this invention;

Figure 4:
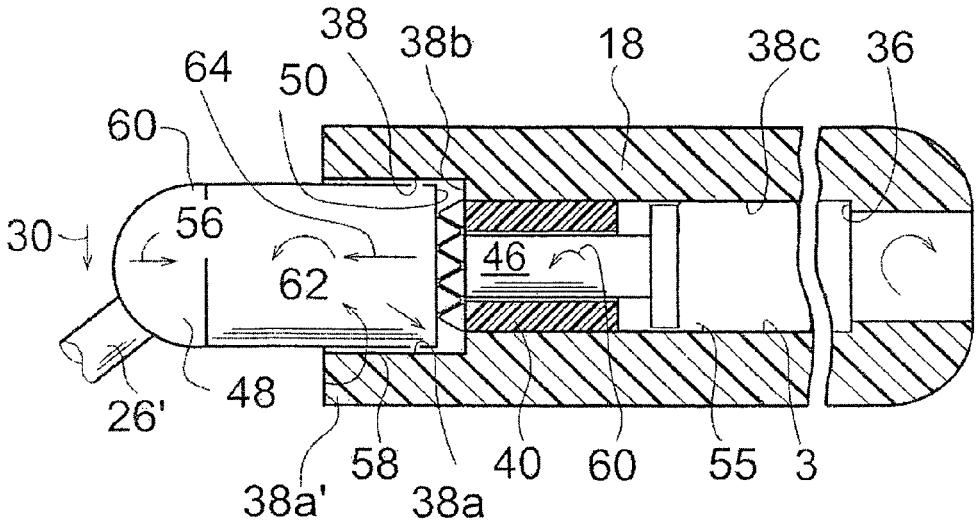
FIG. 4 is a side elevation assembly view, at a still more greatly enlarged size in comparison to that of FIG. 3, and partially in cross section, showing the rotational and clutching mechanisms of the inventive spoon.
Figure 5:
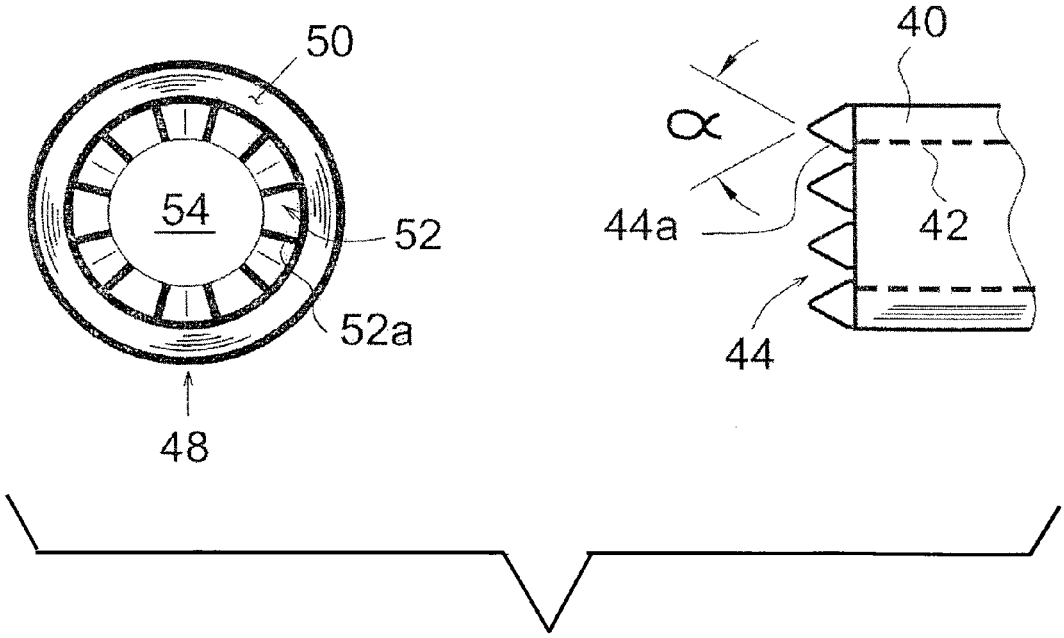
Figure 6:
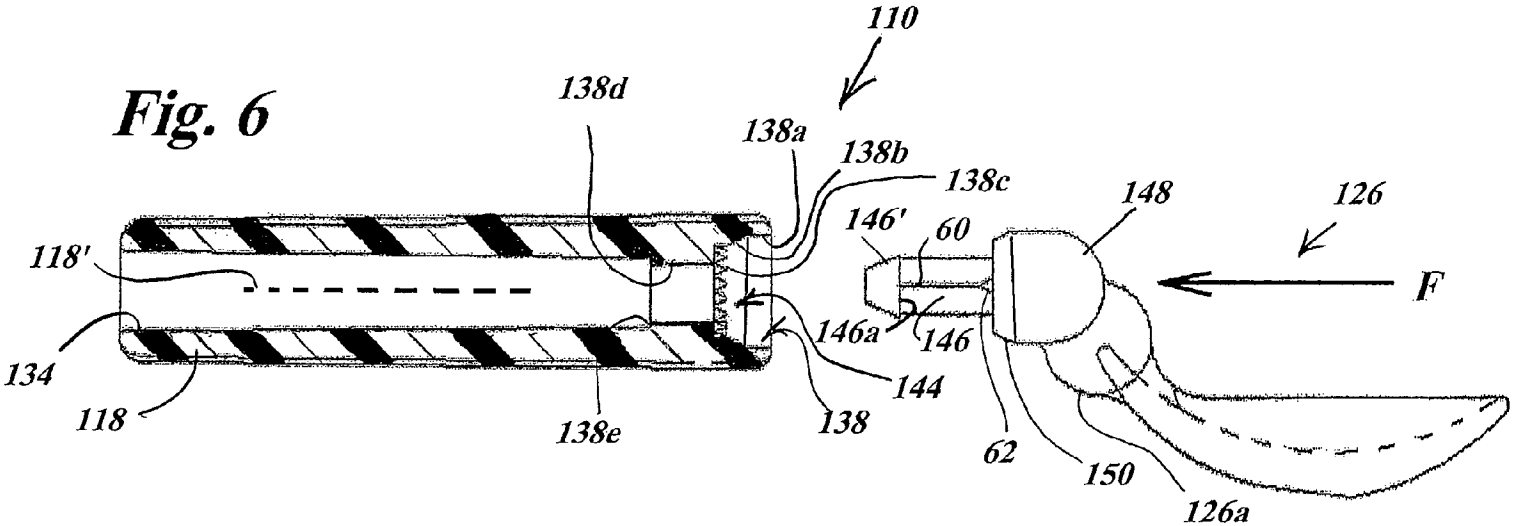
Figure 7:
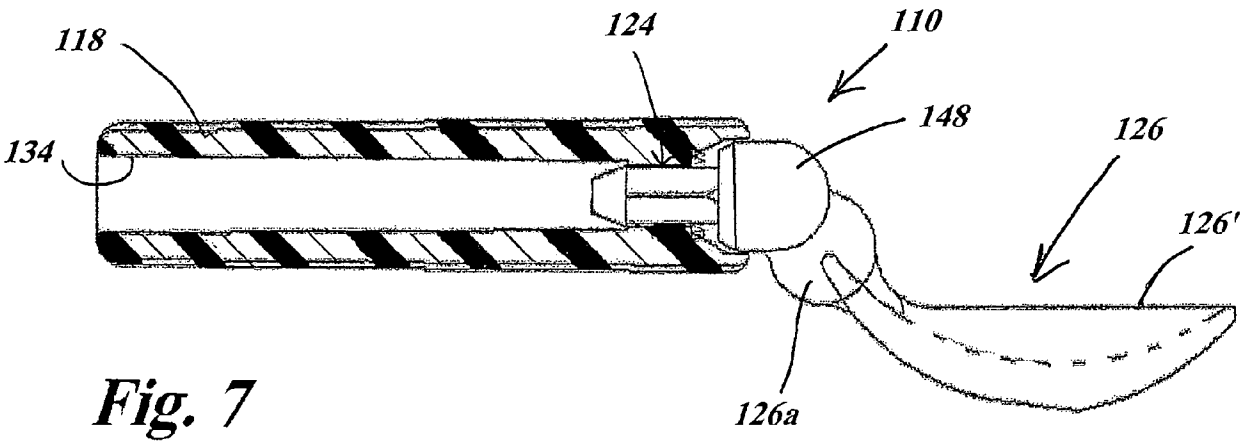

FIG. 5 is view combining a side view and an axial view of portions of the spoon seen in FIG. 4, and at a still more greatly enlarged size compared to FIG. 4, so as to show details of the rotational and clutching mechanism according to this invention, and with the element in the left-hand side of this Figure rotated 90° to face the viewer in axial view so as to better illustrate details of the structure;

FIGS. 6 and 7 respectively provide a side elevation exploded view, and a side elevation assembly view, each partially in cross section, of an alternative embodiment of the present inventive self-leveling spoon.

DETAILED DESCRIPTION OF AN EXEMPLARY PREFERRED EMBODIMENT OF THE INVENTION

An ambidextrous spill-resistant spoon 10 according to the present invention is illustrated in FIG. 1. The ambidextrous spill-resistant spoon is shown in FIG. 1 as it would appear when held in the right hand of a user (not seen in the drawing Figures) while being used to scoop up food 12 from a bowl 14. The viewer of FIG. 1 is presented generally in the position of (and has the general point of view of) the user of the spoon 10. As illustrated, the user is scooping up food by inserting the spoon bowl into the food, and drawing the spoon and food toward the user using the right hand.

As is seen in FIG. 1, the natural scooping motion for a spoon held in the right hand is downwardly and into the food (illustrated by axial arrow 16 along the axis of a handle portion 18 of the spoon 10) with the user then drawing the spoon 10 toward the user (illustrated by arcuate arrow 20—this arrow being directed generally out of FIG. 1 toward the viewer of this Figure) and possibly in combination with a rotation of the handle portion 18 in a clockwise direction (indicated by rotational arrow 22). This relative rotation indicated by arrow 22 results most naturally from articulation of the users wrist, elbow, and shoulder as the right hand holds the spoon 10 while this spoon is drawn into and through the food 12 toward the user. As these motions are conducted by the user of the spoon 10 a rotational and clutching mechanism (generally indicated with arrowed numeral 24) within the handle 18 of spoon 10 and which is responsive to these motions and resulting forces clutches the bowl portion 26 to the handle 18 in order to allow torque to be applied in the direction indicated by arrow 22.

Of course, it is understood that these motions are not distinct and discreet, but occur in combination with one another essentially as a single scooping motion by the user of the spoon 10. FIG. 1 also shows that as a reaction to the downward motion 16 of the spoon 10 into the food 12, the bowl portion 26 of the spoon experiences an axially directed reaction force, indicated by arrow 28. It will be seen that a very early and initial result of this reaction force 28 is a slight axial relative movement of the bowl 26 toward handle portion 18 and the engagement of rotational and clutching mechanism 24 in order to sustain clockwise torque 22. That is, the bowl 26 is temporarily locked non-rotationally to the handle portion 18.

Moreover, during the scooping motion indicated in FIG. 1, it is desirable to have the handle portion 18 clutch to the bowl portion 26 so that the user may more effectively scoop up food 12 onto this bowl portion 26 of the spoon. However, as is seen in FIG. 2, once the user has loaded the bowl portion 26 of the spoon 10 with food (indicated by the weight arrow 30) and lifted the spoon 10 free of the food 12, then it is desirable to have the handle portion 18 and bowl portion 26 be freely rotational relative to one another, as is indicated by bi-directional arrow 32. It follows that the spoon bowl 26 is now also freely rotational relative to the handle portion 18. The bi-directional arrow 32 indicates that the handle portion 18 is freely rotational in both directions about an axis 18' relative to the bowl portion 26. Accordingly, as a result of an offset (indicated by vertical distance Y) of the bowl portion 26 below the axis 18' of handle 18, the weight of the bowl portion 26 in combination with the food held in this bowl portion (recalling weight arrow 28) causes the bowl portion 26 to swing or rotate freely like a pendulum about axis 18' as the user moves the spoon toward the users mouth. Thus, even though the user may have undeveloped or impaired fine motor coordination of the fingers and wrist, the motions of the user's elbow and shoulder in moving the spoon to the user's mouth will be sufficient. And, rotational motion of bowl portion 26 relative to handle portion 18 will result in the bowl 26 remaining substantially level about the axis 18', and thus will essentially prevent food from spilling off the sides of the spoon bowl 26.

In order to achieve the necessary automatic clutching and un-clutching of the bowl portion 26 and handle portion 18 (recalling FIGS. 1 and 2), in conjunction with the free rotational relationship desired during movement of the loaded spoon 10 to a user's mouth (recalling arrow 32 of FIG. 2), the present invention uses a rotational and clutching mechanism or assembly 24 having the following attributes in combination:

at the beginning of the scooping motion which places food on the spoon, clutching of bowl 26 and handle 18 together in response to axial force and very slight axial motion of the bowl portion 26 toward handle portion 18;

during the scooping motion (recalling arrow 22 of FIG. 1), maintenance of clutching of spoon bowl to handle portion in opposition to applied torque;

when the scooping motion is completed (i.e., by clearing of the spoon from the food 12), immediate un-clutching (i.e., bowl 26 freely rotational relative to handle 18); and free rotational motion (i.e., side to side leveling) of the bowl 26 relative to handle 18 during transport of the loaded spoon to the user's mouth (recalling arrow 32 of FIG. 2).

Considering FIGS. 3-5 in combination, and keeping FIGS. 1 and 2 in mind, it is seen that the present invention achieves these objectives and actions by use of a structure that is robust, exceedingly simple mechanically with a minimum of parts, and which also achieves a unique structure utilizing a combination of physical effects to achieve its operation. Turning first to FIG. 3, it is seen that the handle 18 is formed of a tubular body preferably having a stepped through bore or passage 34.

At a distal end of the handle 18 (i.e., the left end of this handle for a viewer of FIG. 3), the handle portion 18 defines a counter bore 38 having a first cylindrical section 38*a*, an axial shoulder 38*b*, and another or inner cylindrical section 38*c*. The section 38*c* may, if desired, extend substantially the full length of the spoon handle 18 to define most of the passage 34.

The handle 18 defines a collar section 38*a*' at counter bore 38*a*, which collar section acts somewhat as a shield in cooperation with a carrier member to be described below. That is, the collar section 38*a*' assists in preventing or minimizing the entry of food into the spoon 10.

The features of counter bore 38 form a part of the rotational and clutching assembly 24, with the remainder of this mechanism being fitted into the counter bore 38. The mechanism 24 includes a bushing member 40 which at its outer diameter surface may define a removable press fit into the counter bore section 38*c*. Alternatively, the bushing member 40 may be a permanent press fit into the counter bore section 38*c*, or may be permanently secured, as by adhesive bonding or ultrasonic welding, for example, into this bore. Importantly, the bushing member 40 is non-rotational relative to handle portion 28.

Bushing member 40 defines a through bore 42. At its distal axial end surface, the busing member 40 defines a circular array of fine-dimension, axially-extending engagement teeth, generally indicated with the arrowed numeral 44 in FIG. 3. Preferably, as is seen best in FIG. 5, these engagement teeth are wedge-shaped, and are substantially symmetrically circumferentially, so that they prevent relative rotation when engaged, and produce an equal axial disengaging force in response to torque in either direction. Rotationally received through bore 42 is a headed shaft member 46. That is, the shaft member 46 includes a head portion 46*a* and a distally extending cylindrical portion 46'. Non-rotationally received permanently on the distal portion 46' of shaft member 46 is a carrier member 48. This carrier member 48 carries the shaft 26' of spoon bowl 26. Also, this carrier member 48 defines a cylindrical section 48' which is received into section 38*a* of counter bore 38 with a radial clearance somewhat greater than the radial clearance between shaft member 46 and bore 42 of bushing member 40. Thus, the carrier member 48 at surface 48' is closely spaced from and freely rotational within the collar 38', and these elements cooperatively form a shield resisting entry of food particles into the mechanism 24. That is, integral parts of the handle 18 and of carrier member 48 serve as a self-formed shield structure to resist entry of food particles into the rotational and clutching mechanism.

Carrier member 48 also defines a shoulder 50 confronting the step 38*b* on bore 34 at counter bore 38. Also, at its proximal axial end surface, the carrier member 48 defines a circular array of fine-dimension axial engagement teeth, generally indicated with the arrowed numeral 52 in FIG. 3. The engagement teeth 44 and 52 are matching in configuration, with an included angle as indicated at $\alpha$ on FIG. 5, defined between wedge-like axially and circumferentially extending surfaces 44*a* and 52*a*. When the teeth 44 and 52 are engaged with one another, they sustain torque applied at handle 18 and reacted at spoon bowl 26, as is best seen in FIGS. 4 and 5. Within the array of engagement teeth 52, the carrier member 48 defines a blind bore 54 permanently receiving the end portion 46' of shaft member 46. That is, the end portion 46' may be permanently secured into bore 54 by use of an epoxy adhesive or ultrasonic welding, for example.

Considering now the details revealed in FIGS. 4 and 5, it is seen that the engagement teeth 44 and 52 are of fine dimension. That is, these engagement teeth are preferably only about 0.015 inch deep. Thus, an axial motion of just slightly more than 0.015 between the bushing member 40 and carrier member 48 is sufficient to fully engage or disengage the engagement teeth 44 and 52 with or from one another. Further, the engagement teeth 44 and 52 have a sufficiently shallow included ramp angle (angle $\alpha$ on FIG. 5) so that a very slight axial force will engage these teeth, and yet the engaged teeth will then sustain an applied torque between the handle 18 and bowl 26 of the spoon 10. So, viewing FIG. 5 it is seen that the engagement teeth 44, 52 each have an engagement surface 44*a*, 52*a*, and when these engaged teeth are subject to an applied torque in the absence of an axial force, they tend to wedge out of engagement, and allow the spoon bowl to pivot on shaft 46 freely relative to handle portion 18. Further, these engagement teeth also have an axial wedging action tending to disengage from one another as a result of radial clearance between the shaft 46 and bushing 60. That is, when loaded with food and lifted, the spoon bowl tends to droop a small amount due to the radial clearance just explained, and this drooping assists in disengaging the teeth 44 and 52 from one another.

Further, now viewing FIG. 4, it is to be understood that the sequence of events during scooping of food with the spoon 10 first results in a slight axial motion 56 (recalling axial forces 16 and 28 illustrated on FIG. 1, as the spoon is pushed into the food 12 (or along the bottom of the plate or bowl containing the food 12). This slight axial motion 56 is sufficient to both engage the engagement teeth 44 and 52 with one another (as seen in FIG. 4). Because the engagement teeth 44 and 52 are engaged, the torque 22 is sustained, and the spoon 10 is effective to scoop up food. However, as soon as the spoon bowl 26 clears the food 12, a combination of factors is effective to declutch the mechanism 24 (i.e., to disengage the engagement teeth 44 and 52) and to make the spoon bowl 26 freely pivotal like a pendulum below axis 18'. That is, the weigh of the spoon bowl 26 and the weight 30 of food therein is effective to produce a torque 58 acting on the wedge surfaces 44*a* and 52*a* of the teeth 44, 52 to move the carrier 50 axially, and to disengage the teeth 44, 52. And, slight drooping of the spoon bowl because of radial clearance between shaft 46 and bushing 40 assists in axially wedging the teeth 44 and 52 axially apart. By selection of the included angle 44*a*, 52*a* of the teeth 44 and 52, and the radial clearance between shaft 46 and bushing 40, positive engaging and disengaging of the clutch mechanism 24 may be achieved.

The forces acting on the carrier 48 are a gravitationally-produced torque from the weight of the spoon bowl 26 and food 30, along with possibly a gravitational axial vector because the spoon may be canted downwardly, and an axial force resulting from the wedging (i.e., drooping because of radial clearance as explained above) apart of teeth 44 and 52. This combination of forces is sufficient to un-clutch the teeth 44 and 52, and allow the spoon bowl 26 to self-level, somewhat like a pendulum below the pivot axis 18'. In view of the above, it is seen that the present inventive spoon clutches in response to a user input (i.e., a natural scooping motion with the spoon), and un-clutches solely in response to gravitational forces effective on the spoon—especially when loaded with food. The result is an almost immediate and imperceptible transition of the spoon bowl 26 from a clutched condition to an unclothed and freely pivotal condition, in which the spoon bowl is self-leveling from side to side in order to better retain food thereon. Even though the weight of the spoon bowl 26 itself and the weight 30 of food thereon is not great, the un-clutching action accomplished by the present invention is positive and reliable. Importantly, the torque effect and axial vector or wedging effect together are very effective to overcome static friction and to (once motion begins) convert the static frictional relationship of shaft 46 with bushing 40 to one of dynamic friction. Thus, "stiction" of the spoon bowl in one rotational position is avoided, and the spoon bowl 26 pivots freely like a pendulum below axis 18'. It follows that the spoon 10 automatically levels from side to side and substantially retains food thereon, so as to provide a person with undeveloped, reduced, or impaired coordination a useful improvement in their ability to feed themselves.

Turning now to FIGS. 6 and 7, an alternative embodiment of the present inventive self-leveling spoon is depicted. Because this embodiment shares many features in common with the first embodiment of FIGS. 1-5, features which are the same or which are analogous in structure or function are indicated on FIGS. 6 and 7 with the same numeral used above, but increased by one-hundred (100). The ambidextrous spill-resistant spoon 110 according to the embodiment of FIGS. 6 and 7 includes only two parts. That is, in contrast to the four parts of the embodiment of FIGS. 1-5 (or possibly three parts of this embodiment if the bushing 40 were to be made integral with handle 18), the embodiment of FIGS. 6 and 7 has only 2 parts, and has many advantages. These advantages include reduced manufacturing costs, greater safety, greater ease and effectiveness in cleaning, a great reduction in the number of crevices in which food particle and other contaminants can become trapped, and importantly, an improved un-clutching action. Because the embodiment of FIGS. 6 and 7 un-clutches so quickly and positively when a user lifts the loaded spoon, its action becomes "transparent" to the user, resulting in greater ease of use and reduced food spillage. Also importantly, both of these two parts of the embodiment of FIGS. 6 and 7 is especially configured to allow their manufacture by use of injection molding, while yet retaining all of the functionality (and better functionality) of the embodiment earlier depicted and described. The function of the embodiment of FIGS. 6 and 7 is the same as that of the first embodiment, with the additional functions and advantages described below.

The two parts of the self-leveling spoon 110 seen in FIGS. 6 and 7 include a handle portion 118 and a spoon bowl portion 126. The handle portion 118 and spoon bowl portion 126 cooperatively define and form a unique bi-directional and solely gravity-responsive clutching mechanism (generally indicated with arrowed numeral 124—best seen in FIG. 7). Briefly stated by way of introduction, the embodiment of FIGS. 6 and 7 is responsive when the spoon bowl is loaded with food, to un-clutch in response to a triune combination of forces. First, a gravitational torque is effective because of the lever arm "Y" and is effective in both rotational directions through wedge-shaped engagement teeth. In addition, a dual-action, or dual-function axial force, which is also effective in both directions of rotation for the spoon bowl acts to un-clutch the engagement teeth. That is, a slight radial sag of the spoon portion relative to the handle results in contact of and sliding relative movement of conical surfaces formed on the spoon bowl portion, and interiorly of the handle portion. These conical surfaces provide a first axial disengaging or un-clutching force. Secondly, the wedge-shaped engagement teeth themselves as a result of this slight radial sag mentioned above, act to wedge themselves out of engagement with one another. This wedging of the engagement teeth out of engagement (i.e., un-clutching) is also effective in both directions of relative rotation of the spoon bowl portion relative to the handle portion. So, a combination of torque acting on wedge shaped engagement teeth, and axial forces resulting from radial sag bringing conical surfaces into contact, and tending to additionally wedge apart the wedge-shaped engagement teeth, produces essentially immediate un-clutching of the spoon embodiment seen in FIGS. 6 and 7 when it is loaded with food and lifted by a user. In summary, as with the first embodiment depicted by reference to FIGS. 1-5 and described above, spoon 110 is responsive to the natural food-scooping motions and resulting forces so as to clutch the bowl portion 126 to the handle 118 during scooping in order to allow food to be loaded onto the bowl portion, and to un-clutch immediately thereafter in response to gravity-induced forces so as to self-level from side to side, thus assisting in retaining food on the spoon.

Considering FIGS. 6 and 7 in conjunction with one another, it is seen that the handle 118 is formed as a tubular body having a stepped and especially configured through bore or passage 134. At a distal end of the handle 118 (i.e., the right-hand end of this handle for a viewer of FIGS. 6 and 7), the handle portion 118 defines a counter bore 138 having a first cylindrical section **138*a* which leads to a conical tapering or converging section 138*b*. Adjacent to and radially inside of the conical tapering section 138*b* is an axial shoulder 138*c*, and another or inner cylindrical bore or bearing section 138*d*. Beyond the cylindrical section 138*d*, the diameter of bore 134 enlarges to provide a shoulder 138*e* facing away from the shoulder 138*c*. Disposed on the shoulder 138*c* is a radially arrayed plurality of wedge shaped engagement teeth 144 essentially the same in design and function as those depicted and described by reference to FIGS. 1-5. It will be noted that the embodiment of FIGS. 6 and 7 includes no bushing such as bushing 40, but integrally incorporates the engagement teeth 144 and the bearing surface 138*d* (functionally equivalent to bore 42 described above) into the handle portion 118 itself. Further, it will be noted that features of the handle portion 118 defined on bore 134 and indicated with numerals 138 cooperatively form interacting parts of the gravity-responsive rotational and clutching assembly 124**, as will be further explained.

Particularly viewing FIG. 6, it is seen that the spoon bowl portion 126 includes a bowl portion 126' which is connected to a carrier portion 148 via a lever part **126*a*. In other words, the lever part 126*a* insures that the bowl portion 126' is spaced below the axis 118' of the handle 118, as will be understood in view of the disclosure above. The carrier portion 148 defines a conical wedging surface 150 confronting and engageable with the conical surface 138*b* of handle portion 118. Also, this carrier portion 148 carries an axially projecting stem part 146 having a conical head 146' of enlarged diameter (i.e., in comparison to the diameter of the stem 146, and in comparison to the diameter of bore 138***d*). The head 146' defines a shoulder 146*a* which will be seen to be engageable with the shoulder 138*e* within handle 118, as will be further explained.

Importantly, the bowl portion 126 is preferably manufactured also by injection molding such that it has parting lines (i.e., where the injection molding die halves abut one another—and only one of which is seen in FIGS. 6 and 7) at 60 along the side of stem 146. A similar parting line is located on the diametrically opposite side of stem 146. Those ordinarily skilled in the pertinent arts will understand that the bowl portion 126 has other parting line sections, which are not illustrated in FIGS. 6 and 7. But, importantly, it is to be understood that the bowl portion 126 is one integral or unitary piece, molded to its finished (or near finished) shape. Accordingly, as FIGS. 6 and 7 illustrate, the bowl portion 126 defines on the carrier portion 148 and in alignment with the parting lines 160 a diametrically opposed pair of axially and radially extending engagement teeth 62 (only one of which is seen in FIGS. 6 and 7). In other words, the embodiment of FIGS. 6 and 7 employs only a pair of diametrically opposed engagement teeth on the spoon bowl portion 126. The pair of engagement teeth on carrier portion 148 are engageable with the engagement teeth 144 of handle portion 118 in response to a slight axial force on the handle portion 118, as will be understood in view of the disclosure above.

Once the handle portion 118 and bowl portion 126 are manufactured, and are brought into the relative positions seen in FIG. 6, a strong axial force (indicated by arrow F on FIG. 6) is employed to force the head 146' of stem 146 through the bore portion 138*d*. This is a one-time-only passage of the head 146' through bore 138*d*. And, although this force fitting of the handle and bowl portion together can be accomplished with each at room temperature, it is helpful to have the molded plastic of the handle portion be at a slightly elevated temperature so that the plastic is more pliable. Once the handle portion 118 and bowl portion 126 have been assembled to their relationship seen in FIG. 7, there is no risk that a child (or anyone else for that matter) will disassemble the spoon. In fact, any forceful attempt to separate the handle and spoon bowl portions would be beyond the strength of a child, and is likely to be unsuccessful or to break the stem 146 so that the spoon is not usable. Thus, any risk of a child swallowing or choking on small parts of the spoon is entirely eliminated by the present embodiment. When assembled to their positions seen in FIG. 7, there stem 146 has an axial freedom of movement just slightly greater than the height of the engagement teeth 144 and 62. The spoon bowl portion 126 thus has rotational freedom as well, and may also droop or wiggle a selected amount due to radial clearance of stem 146 in bore portion 138*d*.

Again, as will be recalled from the explanation above, there exists a selected radial clearance between the stem 146 and the bore 138*d*. This selected radial clearance in combination with the weight of food loaded onto the spoon bowl tends to make the spoon bowl droop or sag slightly when lifted, within the limits of this radial clearance. As a result, the engagement teeth 62 tend to wedge themselves out of engagement with the teeth 144 of the handle portion. This action of the food-loaded spoon bowl drooping and wedging itself toward disengagement or un-clutching, is assisted by the cooperation of the conical surface 150 slidably engaging on the conical surface 138*b* of the handle portion. In this respect it is to be noted that the pair of engagement teeth 62 are disposed relative to one another along a horizontal line, generally parallel with the sides of the spoon bowl, and that this orientation of the pair of engagement teeth tends to insure that they both disengage as the spoon is lifted with a load of food and the spoon bowl droops slightly (i.e., due to gravity), so as to un-clutch the spoon bowl and allow it to self-level from side to side.

Also, in addition to the above, and as was explained with reference to the embodiment of FIGS. 1-5, the engagement teeth 144, 62 are themselves wedge shaped. As a consequence, when a user of the spoon 110 completes a scooping motion and lifts the loaded spoon (assuming the spoon is not already level from side to side) the torque applied by lever part 126*a* as a result of the food weight (i.e., due to gravity) tends also to wedge the engagement teeth out of engagement. So, the spoon 110 un-clutches and the spoon bowl 126' levels from side to side like a pendulum, assisting the user in keeping food on the spoon. In view of the above, it is seen that the un-clutching action of both the embodiment of FIGS. 1-5, and that of the embodiment illustrated in FIGS. 6-7 is solely gravitational. The mechanical simplicity and subtle operation of the present inventive spoon both makes it inexpensive to manufacture and reliable in its operation. Also, cleaning of the spoon is simplified and made easier by the limitations of the number of parts. Especially with the embodiment of FIGS. 6 and 7, the present inventive spoon provides a simple, reliable, and safe product for use by the very young and the very old.

While the foregoing description and drawings represent a preferred embodiment of the present invention, it will be understood that various additions, modifications and substitutions may be made therein without departing from the spirit and scope of the present invention as defined in the accompanying claims.

What is claimed is:

1. An ambidextrous spill-resistant spoon apparatus which is responsive to gravity alone to self-level, said spoon apparatus comprising:

an elongate handle portion defining a longitudinal axis;

a spoon bowl portion having a shaft part;

a rotational and clutching apparatus connecting said handle portion and said spoon bowl via said shaft part so that the spoon bowl is relatively rotationally supported below said longitudinal axis and said spoon bowl portion extends axially from said handle portion, said rotational and clutching apparatus further being responsive to a user input including an axial force pushing said handle portion and spoon bowl toward one another to clutch said spoon bowl non-rotationally to said handle portion to resist torque in both rotational directions in the presence of said axial force, and said rotational and clutching apparatus in the absence of said user input axial force and in response to the user lifting said spoon apparatus being responsive to gravity alone to un-clutch allowing said spoon bowl to freely rotate about said longitudinal axis.

2. The ambidextrous spill-resistant spoon according to claim 1, wherein said user input includes application by a user of an axial force along said handle pushing the spoon into food or against a bowl bottom such that the spoon bowl reacts axially to move said shaft part axially inwardly of said handle portion, whereby reaction of the spoon bowl against an object such as a plate or food is sufficient to effect clutching of the spoon bowl to the handle portion.

3. The ambidextrous spill-resistant spoon according to claim 2 wherein said rotational and clutching apparatus provides for said spoon bowl to move a determined distance axially of said longitudinal axis relative to said handle portion to effect clutching of said apparatus, and said spoon bowl portion moving through said determined distance away from said handle portion and solely in response to gravity in order to un-clutch said rotational and clutching apparatus.

4. The ambidextrous spill-resistant spoon according to claim 3 wherein said rotational and clutching apparatus includes a bushing member and a shaft member rotationally and axially movably associated with one another, each of said bushing member and said shaft member further being drivingly connected to a respective one of a pair of circular arrays of like-configured axially and circumferentially extending engagement teeth, and said pair of circular arrays of engagement teeth drivingly engaging one another to sustain torque in both directions in response to axial force and resulting relative movement of said shaft member and bushing member, and said shaft member and bushing member cooperatively defining a selected radial clearance providing for said spoon portion to sag radially when loaded with food and lifted by a user, whereby said radial sag assists in disengaging said engagement teeth.

5. The ambidextrous spill-resistant spoon according to claim 4 wherein said pair of circular arrays of engagement teeth each define a selected included angle, such that said engagement teeth tend to wedge apart in response to torque and said radial sag in the absence of said axial force.

6. The ambidextrous spill-resistant spoon according to claim 5 wherein one of said axial arrays of engagement teeth includes only a diametrically opposite pair of engagement teeth.

7. The ambidextrous spill-resistant spoon according to claim 4 wherein said spoon portion defines one of said circular arrays of engagement teeth, and said bushing member defines the other one of said pair of circular arrays of engagement teeth.

8. A method of providing an ambidextrous self-leveling, spill-resistant spoon, said method comprising steps of:

providing an elongate handle portion defining a longitudinal axis;

providing a spoon bowl portion having a shaft part;

providing a rotational and clutching apparatus connecting said handle portion and said spoon bowl portion so that the spoon bowl is relatively rotationally supported below said longitudinal axis, configuring said rotational and clutching apparatus to be responsive to an axially directed force provided by a user moving said spoon bowl portion toward said handle portion to clutch said spoon bowl to said handle portion to resist torque in both directions and to be responsive to gravity torque and to gravity axial force in the absence of said axial force provided by a user to un-clutch solely in response to gravity force, thus allowing said spoon bowl to freely rotate about said longitudinal axis and to self-level.

9. The method of claim 8 further including steps of:

configuring said rotational and clutching apparatus to include a bushing member carried by said handle portion and said shaft part being rotationally and axially movably received into said bushing member;

providing for said bushing member and shaft part to cooperatively define a radial clearance, so that said spoon portion can radially sag when loaded with food and lifted by a user;

providing each of said bushing member and said shaft part to be drivingly connected to a respective one of a pair of circular arrays of engagement teeth such that said pair of circular arrays of engagement teeth drivingly engaging one another to sustain torque in both directions in response to axial relative movement of said shaft part and bushing member toward one another caused by a user-input force, and so that said pair of circular arrays of engagement teeth wedge apart in response to gravity-applied torque and in response to gravity-caused radial sag in the absence of said axial force as a user lifts said spoon apparatus loaded with food.

10. The method of claim 9 further including the step of providing each engagement tooth of said pair of circular arrays of engagement teeth with a sloping tooth surfaces defining a selected included wedging angle.

11. The method of claim 10 further including the step of: providing said handle portion with a female axially disposed conical surface opening toward said spoon portion, and providing said spoon portion with a male axially disposed conical surface about said shaft part and engageable with said female conical surface in response to said user input force, whereby said radial sag of said spoon portion slidably engages said conical surfaces, and in response to a user lifting said spoon apparatus loaded with food, causes axial disengagement of said engagement teeth.

12. An ambidextrous self-leveling and spill-resistant spoon apparatus consisting essentially of only two components:

a first component of said spoon apparatus being an elongate handle portion sized and configured to be grasp by the human hand, said handle portion defining a longitudinal axis, and a bore extending along said longitudinal axis to open axially upon said handle portion, a first circular cylindrical portion of said bore adjacent to but spaced from said bore opening defining a bearing surface of determined inside diameter, an axially disposed array of wedge-shaped bi-facial engagement teeth disposed adjacent to said bearing surface, and outwardly toward said bore opening relative to said engagement teeth said handle portion defining an axially extending outwardly flaring female conical surface of selected cone angle;

a second component of said spoon apparatus being a spoon portion having a shaft part connecting to a carrier portion and to a spoon bowl portion via a lever part extending between said carrier portion and said spoon bowl portion so that said spoon bowl portion is spaced axially from said handle portion and radially from a pivot axis at said shaft part, said carrier portion defining a pair of diametrically opposed engagement teeth of wedge-shape which are engageable with like engagement teeth of said handle portion, and an exterior male conical surface portion confronting and engageable with said female conical surface portion of said handle portion, and said shaft part being rotationally and axially movably receivable into said bearing surface so that said engagement teeth axially engage and said conical surfaces confront one another, and in cooperation with said bearing surface said shaft part forming a selected radial clearance so that said spoon bowl portion may sag radially relative to said handle portion in response to a user lifting said spoon apparatus thus providing a counter torque as well as an axially directed disengaging force via said conical surfaces slidably engaging and said wedge-shaped engagement teeth wedging apart all in response only to gravity to cause said spoon bowl to swing freely and self-level.

13. The ambidextrous spill-resistant spoon according to claim 12, wherein said spoon portion is manufactured using injection molding producing a parting line on said spoon bowl portion, and said parting line extends along said carrier portion and said shaft part, with said pair of wedge shaped engagement teeth being aligned on said parting line and diametrically opposite each other.

14. The ambidextrous spill-resistant spoon according to claim 12 wherein said spoon portion further includes disposed at a distal end of said shaft part an enlarged conical head of a size too large to freely pass through said bearing surface, and said handle portion being formed of a polymer material sufficiently resilient that said enlarged conical head can one time only be forced through said bearing surface to rotationally dispose said shaft part axially movably within said bearing surface of said handle portion.

15. The ambidextrous spill-resistant spoon according to claim 14 wherein said enlarged conical head of said shaft part forms a shoulder disposed toward said carrier portion, and said shoulder in cooperation with said conical surfaces provide for said spoon portion to move axially relative to said handle portion a sufficient distance to engage and disengage said wedge-shaped engagement teeth relative to each other.

* * * * *